US005254173A

United States Patent [19]

Myers

[11] Patent Number: 5,254,173

[45] Date of Patent: Oct. 19, 1993

[54] TURNTABLE MECHANISM

[75] Inventor: William N. Myers, Huntsville, Ala.

[73] Assignee: The United States of America as represented by the Administrator of the National Aeronautics and Space Administration, Washington, D.C.

[21] Appl. No.: 828,612

[22] Filed: Jan. 31, 1992

[51] Int. Cl.[5] ..... B05C 13/00

[52] U.S. Cl. ..... 118/728; 118/500; 118/730; 269/71

[58] Field of Search ..... 118/500, 730, 728, 719; 269/71

[56] References Cited

U.S. PATENT DOCUMENTS

| | | | |
|---|---|---|---|
| 2,783,531 | 3/1957 | Eisler | 269/71 |
| 2,835,964 | 5/1958 | Yarwood | 269/71 |
| 3,046,157 | 7/1962 | Nyman | 427/72 |
| 3,575,133 | 4/1971 | Myers | 118/500 |
| 4,191,791 | 3/1980 | Lyons | 427/425 |
| 4,620,913 | 11/1986 | Bergman | 118/730 |
| 4,633,809 | 1/1987 | Hirose et al. | 118/719 |
| 4,996,942 | 3/1991 | de Boer et al. | 118/730 |
| 5,091,208 | 2/1992 | Pryor | 118/725 |
| 5,094,183 | 3/1992 | Hamasaki | 118/500 |

*Primary Examiner*—Anthony McFarlane

*Attorney, Agent, or Firm*—Robert L. Broad, Jr.; John R. Manning; Guy M. Miller

[57] ABSTRACT

In vacuum plasma spraying a turntable must be provided which not only makes it possible to rotate and tilt a heavy workpiece, but to operate at vacuum plasma temperatures to do so. In the vacuum plasma coating of large parts such as combustion chambers of rocket engines the workpiece must not only be rotated, but it must be tilted. Hence the turntable must be capable not only of supporting heavy parts, but of angulating such heavy workpieces. And this must be done without drive means failure due to extremely high temperatures under which the turntable mechanism is operated. Herein a turntable mechanism is provided which is capable of operating under such conditions. For cooling the turntable drive mechanism internal cooling means are included.

7 Claims, 3 Drawing Sheets

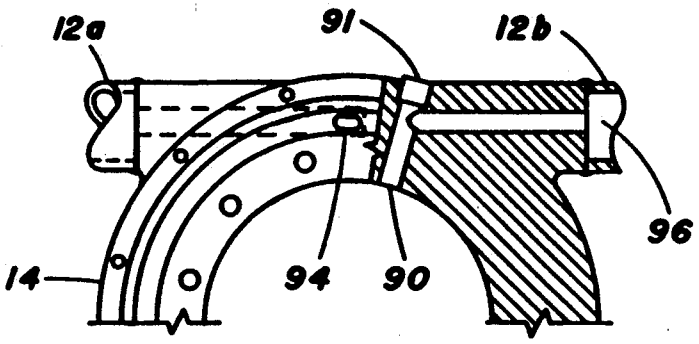
FIG. 4
FIG. 7
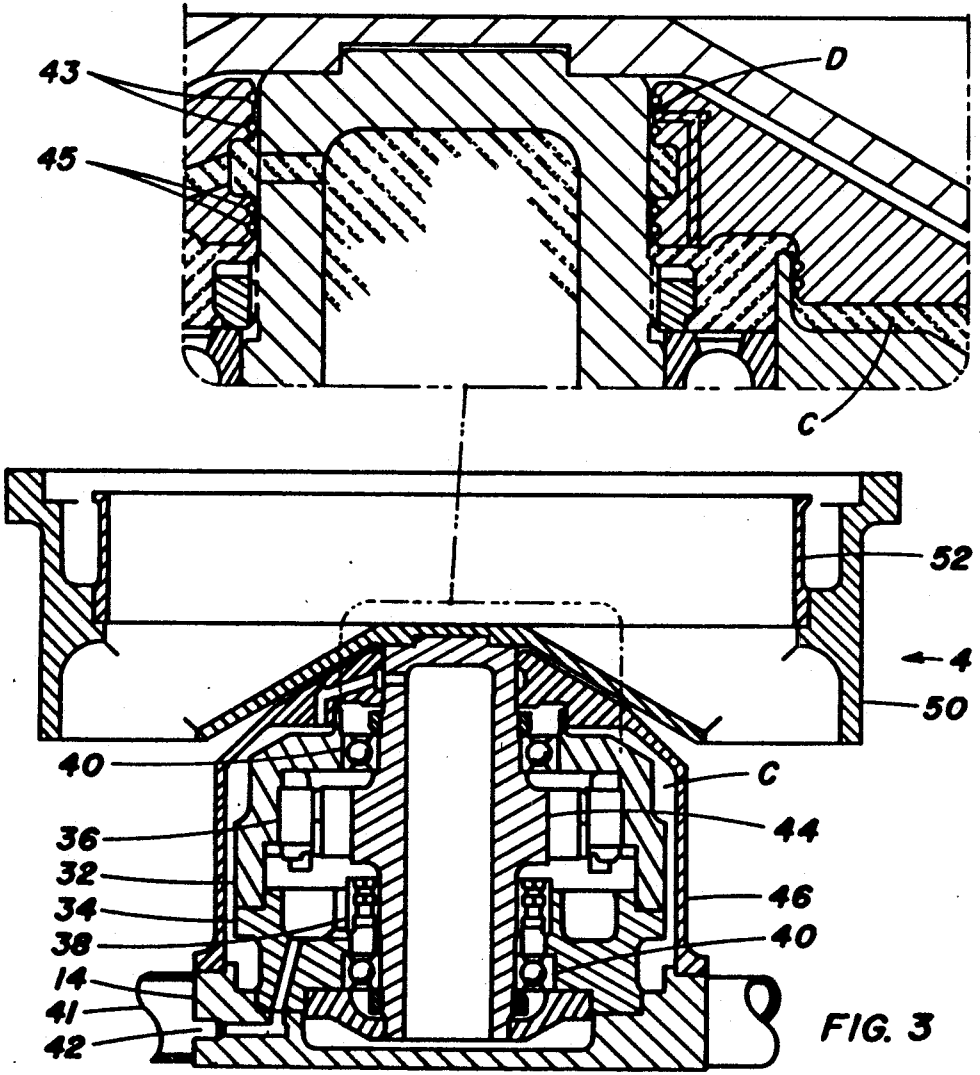
FIG. 3

TURNTABLE MECHANISM

ORIGIN OF THE INVENTION

The invention described herein was made by an employee of the United States Government, and may be manufactured and used by or for Government purposes without the payment of any royalties thereon or therefor.

BACKGROUND OF THE INVENTION

This invention pertains to a turntable mechanism. In a more particular aspect the invention relates to a turntable mechanism intended for use in manipulating a part to be sprayed by a jet of plasma within a vacuum plasma spray chamber. In still another of its embodiments a turntable is provided which is capable of supporting heavy parts such as aircraft engines.

The internal parts and surfaces of turbine or rocket engines and similar parts, such as combustion chambers and turbine blades are subjected to such high temperatures during operation that it is desirable to coat their surfaces with thermal-barrier ceramic coatings. In order to do that the part must be both rotated and tilted. A turntable must therefore be provided which not only makes it possible to rotate and tilt a heavy workpiece, but to operate at vacuum plasma temperatures to do so. Such devices as that shown in U.S. Pat. No. 3,046,157 would not support a turbine engine. Devices such as those described in U.S. Pat. No. 2,783,531 and U.S. Pat. No. 2,835,964, with motors close to the turntable would not withstand high temperatures without burning out the motors.

Vacuum plasma coating with ceramics and high temperature alloys such as zirconium and yttrium entails spraying a jet of ceramic or alloy plasma, in the absence of air, at a temperature of approximately 15,000 degrees C. A plasma spray gun begins to operate when a pulse of current creates an arc across the gap between its electrodes. An inert gas, usually argon in admixture with hydrogen, flows within the arc. As the arc forms, electrons are stripped away from the gas, ionizing it so that it forms a plasma. When a powdered ceramic material or alloy is introduced into this plasma stream the particles are melted by the high temperatures and propelled as a plasma onto a workpiece surface where they solidify, forming a high temperature resistant coating virtually impossible to remove.

In coating such parts as combustion chambers of turbine or rocket engines the workpiece must not only be rotated, but it must be tilted so that the surface being sprayed is approximately perpendicular to the spray gun. Thus the turntable must not only be capable of supporting 750 to 1000 pounds, but of angulating such a heavy workpiece by rotating it about both vertical and horizontal axes. And this must be done without drive means failure due to the extremely high temperatures under which the drive means must operate. Obviously the turntable mechanisms of U.S. Pat. No. 2,783,531 and U.S. Pat. No. 2,835,964 could not be so used. Herein a turntable mechanism is provided which can be so used.

SUMMARY OF THE INVENTION

With a view toward conditions under which plasma spray coatings are conducted a mechanism is provided herein for holding and maneuvering a workpiece which is being worked on under high temperature conditions. The mechanism includes a tubed workpiece carrying member in the form of a tubular cradle adapted to be driven arcuately in either direction about a virtually horizontal axis through its two cradle ends. A workpiece turntable drive mechanism is carried by the cradle. The workpiece turntable is fabricated with a rotatable shaft which is mounted in the drive mechanism to be rotated thereby about an axis transverse to the cradle axis. Means are included for driving the cradle in either direction in its arc. For cooling the turntable drive mechanism internal cooling means are provided within the cradle, within the turntable drive shaft, and within the turntable drive mechanism.

DESCRIPTION OF THE DRAWINGS

FIG. 3 is an enlarged cross sectional view of the turntable and the mechanism for controlling rotation of the turntable.

FIG. 4 is a fragmentary plan view of the base which supports the turntable drive mechanism.

FIG. 7 is an enlarged view of that portion of the turntable drive mechanism delineated by phantom lines in FIG. 3, showing in greater detail the structure of the upper portion of the turntable drive mechanism.

DETAILED DESCRIPTIONS OF THE INVENTION

Figure 1:
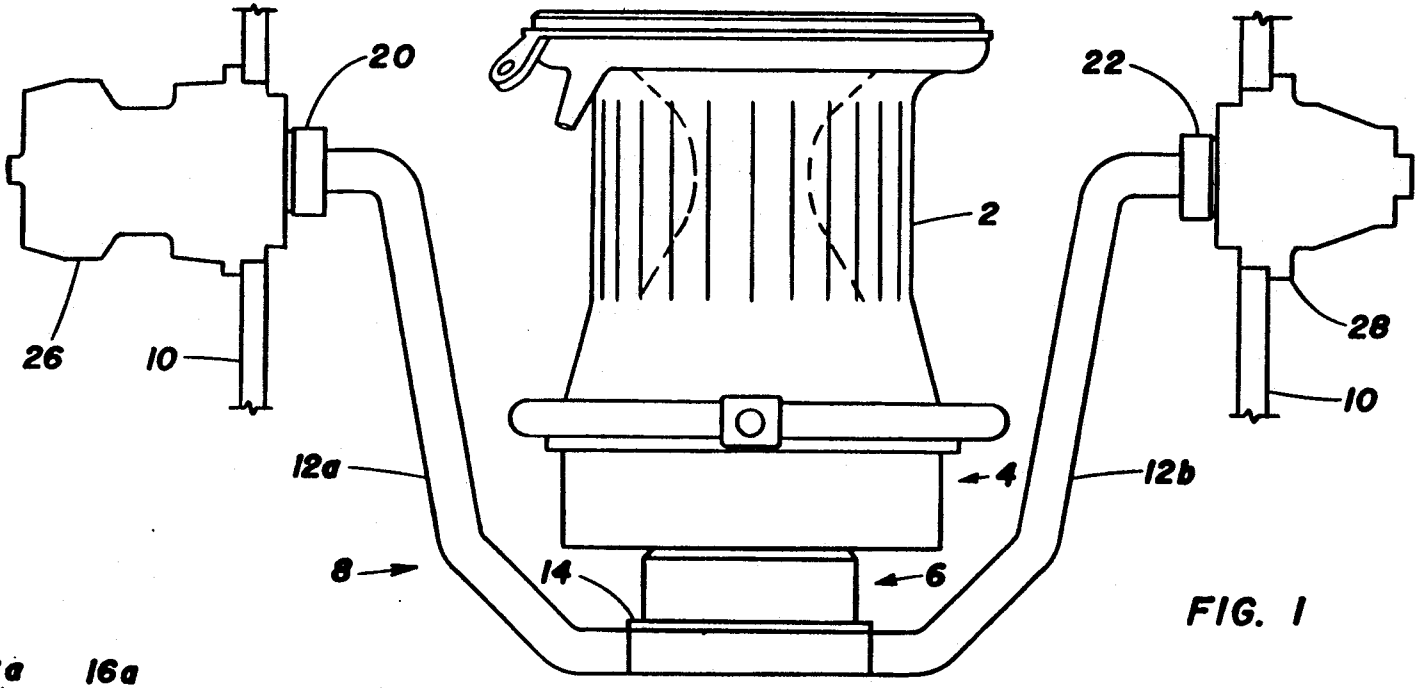
FIG. 1 is a schematic side view showing the general configuration of the invention, where a turntable mounted on a cradle supports a combustion chamber to be treated.

Referring now in detail to the drawings, FIG. 1 shows the invention in a broad sense. A combustion chamber 2 (which is not a part of this invention) to be treated rests on a turntable 4 which can be rotated by a turntable drive mechanism 6. The drive mechanism 6 is mounted on a framework 8 which is carried by a supporting structure fragments of which are shown at 10 in FIG. 1.

Figure 2:
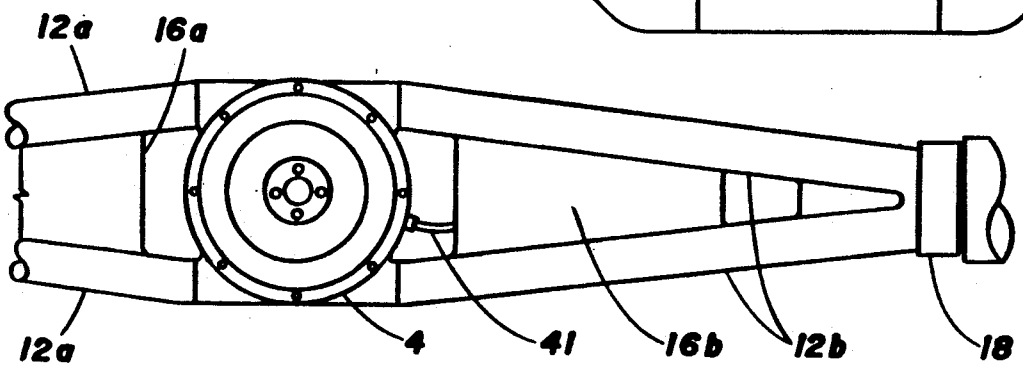
FIG. 2 is an enlarged fragmentary plan view of the cradle and the turntable which supports a combustion chamber to be treated.

It is to be noted that framework 8 is in the form of a cradle composed of two pairs of tube members 12*a* and 12*b*, one member of each pair being shown in FIG. 1, both pairs being visible in FIG. 2. In order to make the device sufficiently strong to hold heavy workpieces, struts or cradle strengthening plates 16*a* and 16*b* are welded between cradle tube members 12*a* and 12*b* respectively. The drive mechanism or turntable base 14 is also welded to tubular cradle 8.

Tubular cradle 8 is adapted to be pivoted, that is, swung, or rotated backwardly or forwardly in an arc about a generally horizontal axis through its two cradle ends, one of which is shown as end 18 in FIG. 2. Essentially these tubular ends are end plates 20 and 22 (FIG. 1) to which cradle tube members 12*a* and 12*b* are welded. Permitting or accomplishing the desired vertical orientation of the workpiece 2 by pivotally moving the tubular cradle, in one direction or the other, are tubular cradle pivot drive 26 and cradle pivot 28 to be described in greater detail in conjunction with FIGS. 5 and 6. Preliminarily, however, turntable 4 will be described.

Turntable 4, along with its drive mechanism, is shown in detail in FIG. 3. As indicated hereinbefore the turntable includes a base 14. This base supports a two piece housing consisting of an upper housing element 32 and a lower housing element 34. This housing encases or encloses a motor 36, and a resolver 38, as well as bearings 40 which support the turntable shaft 44. Conduit 41 and port 42 carry the wires to the motor and the resolver within the housing. The entire turntable drive mechanism is surrounded by a cover 46 which in combination with the housing 32–34 forms a coolant or water jacket whose function will be apparent as the operation of the invention is described.

The turntable 4 is in the form of a spoked turntable deck 50 mounted on shaft 44 (FIG. 3). Within deck 50 is a removable overspray ring 52 upon which the main combustion chamber, or other workpiece, to be treated rests. Overspray ring 52 provides a space so that the plasma spray gun (not shown) can be reversed. It also prevents overspray from building up on the turntable deck 50. The overspray ring is removable because during the plasma spraying operation the ring becomes attached to the main combustion chamber (MCC).

When spraying, the gun should remain virtually perpendicular to the internal hour glass shape of the MCC. This is accomplished by rotating the cradle about pivots 26 and 28, FIG. 1. These pivots are shown in detail in FIGS. 5 and 6.

Figure 5:
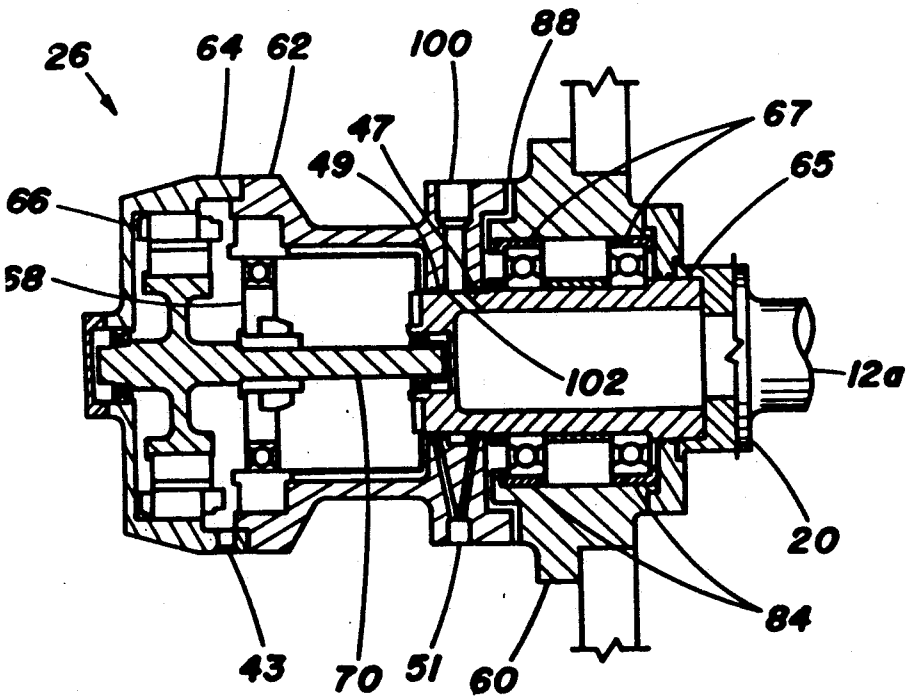
FIG. 5 is a cross sectional view of the cradle drive mechanism connected to one end of the cradle, showing the various parts making up the mechanism.

FIG. 5 is a cross sectional view of the tubular cradle drive and pivot means 26. The cradle drive and pivot means, among other elements, includes three housing units, a pivot housing 60, a drive housing 62 and a motor housing 64. Within the pivot housing 60 are a cradle pivot shaft 65 and bearings 67. Within the drive and motor housings 62 and 64 are a motor 66, a harmonic drive 68, and a cradle drive shaft 70.

Figure 6:
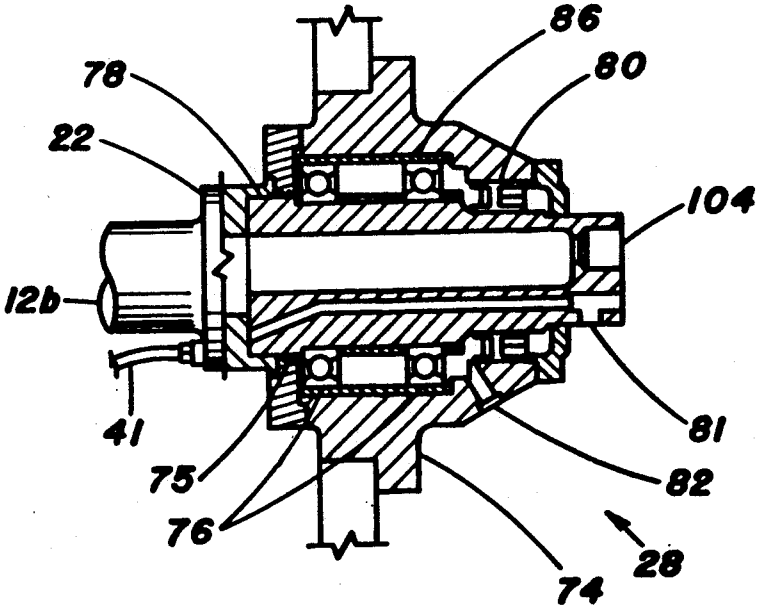
FIG. 6 is a cross sectional view of the cradle pivot at the opposite end of the cradle from the cradle drive mechanism.

FIG. 6 is a cross sectional view of the other tubular cradle pivot. This cradle pivot includes a housing 74, which supports bearings 76, as well as a pivot shaft 78. Also within housing 74 is a resolver 80. Wires for the resolver pass through port 82.

The vacuum plasma spraying operation which is not a part of this invention requires an electric arc to pass from the spray head to the part being sprayed. The cradle, then, is used to complete this electric circuit. Accordingly it must be isolated from the vacuum plasma spray chamber. This is accomplished by using nonmetallic bushings 84 and 86 between the bearings and their housing as shown in FIGS. 5 and 6. By a nonmetallic spacer 88 the current path through the harmonic drive 68 is also isolated.

Considering now the operation of the turntable mechanism, the turntable motor 36, connected to wires entering port 42, rotates the MCC during the spraying operation. A resolver 38 (FIG. 3) in turn provides position feedback, whereas Hall effect devices integral with the motor provide rate feedback. To keep the spray gun (not shown) in its perpendicular position, motor 66 (FIG. 5), within pivot 26, and connected to suitable wiring (port 43) powers the cradle about pivots 26 and 28 (FIG. 1) while harmonic drive 68 (FIG. 5) provides on the order of a 200 to 1 torque increase. In this preferred embodiment of the invention this is necessary due to the 750 pound weight of the MCC. The resolver 80 (FIG. 6) in the pivot housing opposite the cradle drive provides the position feedback so that the conventional control system (not shown) can keep the spray gun perpendicular to the MCC internal surface. Wires passing through port 82 lead to the resolver.

Due to the extreme temperatures within a vacuum plasma coating chamber (not shown), it is necessary to cool the turntable drive mechanism so that the motor will not stop operating. An important aspect of this invention is the provision of a tubular cradle for keeping the system cool. A coolant such as water circulates, not only through the cradle, but through the turntable drive means 6 as well. In this connection reference is made to FIG. 4. Coolant in tubes 12*b* forming a portion of cradle 8 flows into turntable drive means 6 through two ports in the turntable base, 14, one of which is shown as 90 in FIG. 4. Port 90 is fabricated by drilling a bore 91 (which is then plugged), communicating with channel 96 inside tube 12*b*.

A feature of this invention, shown in FIG. 3, is that the coolant flows into hollow turntable shaft 44 as well as in area C (also shown in FIG. 7) which forms a cooling jacket between the motor housing 32–34 and cover 46 thereby cooling both the turntable shaft and the motor. The coolant then leaves the turntable through two openings such as annulus 94 (FIG. 4), flowing into cradle tubes 12*a*. The cradle tubes 12*a* and 12*b* are connected through channels 96 to end plates 20 and 22. Coolant, thus, flows from one end plate 20, through channels 96 in cradle tubes 12*a* through turntable drive means 6, including shaft 44, and then through channels 96 in cradle tubes 12*b* to end plate 22.

Another significant aspect of this invention involves the cooling of both the pivot 28 (FIG. 6) and the pivot drive means 26 (FIG. 5) which are the vehicles for positioning the turntable. The coolant enters through two ports, one being an inlet port shown as 100 in FIG. 5. The coolant then flows through orifice 102 into shaft 65 prior to passing through end plate 20.

After flowing through cradle tubes 12*a* and turntable drive 6 the coolant passes through cradle tubes 12*b* and end plate 22 to cool pivot 28. The coolant enters shaft 78 of pivot 28 and leaves the pivot 28 through port 104.

Still another unique facet of this invention is the sealing means incorporated in the turntable drive mechanism 6 and in pivots 26 and 28. The temperatures utilized in vacuum plasma coating operations dictate the use of special precautions to ensure that coolant is prevented from entering not only the vacuum plasma coating chamber itself, but from entering the motors. To this end, to prevent the coolant from flowing into the vacuum plasma spray chamber, dual dynamic seals are provided. In FIG. 7 O-ring seals 43 and 45 are shown in turntable drive 6. Conduit 41, shown in FIGS. 2 and 6, is connected to a continuous supply of argon. The argon can be tolerated whereas the coolant cannot. As shown in FIG. 7 seals 43 and 45 in turntable drive 6 are continuously pressurized by this inert gas since it can be tolerated within the vacuum plasma supply chamber. The argon-sealed space, area D, between the seals is continuously pressurized so that the gas pressure is always greater than the water pressure. Since the space is under pressure, an increase in the demand for pressure will indicate a leak of sufficient magnitude to dictate a shut down of the coating operation.

A similar pair of O-ring seals 47 and 49 are employed in drive pivot 26 (FIG. 5). The argon is admitted through ports shown as 51. Pivot 28 is similarly cooled. O-rings (75) forming that pressurized seal area are shown in FIG. 6.

Having been given the teachings of this invention modifications and variations will occur to those skilled in the art. Thus, any of the various inert gases can be employed in the sealing means in addition to argon. Further, whereas cylindrical tubing has been described, tubing which is utilized in the cradle can be square, rectangular, or hexagonal in cross-section. Likewise, in addition to water, water-glycerin, or glycol mixtures as well as organic coolants, can be circulated through the cradle and turntable drive units. The direction of flow of the coolant is also within the discretion of the user. Further, whereas welding has been described in the assembling of the mechanism components, bolts can be employed. It will also be appreciated that whereas a preferred drive means has been described for both the turntable and the cradle, other drive means are available, the desideratum being the sealing and cooling means. The same can be said of the turntable positioning means. Other configurations can be used for a turntable positioning a workpiece so long as they are cooled and sealed following the teachings of this invention. Finally, the turntable mechanism of the invention can be used for manipulating parts or workpieces other than turbine engine combustion chambers and rotor blades. And indeed the parts can be otherwise coated or worked on under high temperature conditions. Such ramifications and changes are deemed to be within the scope of this invention.

What is claimed is:

1. A mechanism for holding and maneuvering a workpiece being worked on under high temperature conditions; the mechanism including a tubed workpiece carrying member in the form of a tubular cradle; the cradle having ends adapted for pivotal cradle movement arcuately about a virtually horizontal axis through its ends; means for driving the cradle to tilt said cradle in an arc; a workpiece turntable drive mechanism carried by the cradle; said workpiece turntable having a rotatable shaft affixed thereto; means securing the shaft to the turntable drive mechanism for rotation of the shaft and turntable by the drive mechanism about an axis transverse to the cradle axis; and internal cooling means including interconnected channels within the cradle tubes, the turntable drive shaft and the turntable drive mechanism for coolant flow through the cradle tubes, the drive shaft and the turntable drive mechanism.

2. The workpiece holding mechanism of claim 1 wherein the turntable includes means for securing a workpiece to the turntable.

3. The workpiece holding mechanism of claim 2 wherein the turntable includes an annular cylindrical turntable deck, and means within the annulus for supporting a ring adapted to hold the workpiece.

4. The workpiece holding mechanism of claim 1 wherein the cradle is supported at one end by a pivot means including drive means, bearings, and a means to increase drive torque, and at the other end by pivot means including bearings, and means providing cradle position feedback to a control system.

5. The workpiece holding mechanism of claim 1 wherein the internal cooling means includes a coolant jacket for the turntable drive mechanism, seal means isolating the turntable drive mechanism from coolant within the jacket, and a coolant duct leading from the coolant jacket to the turntable drive shaft, in combination with coolant flow channels forming cradle-cooling passageways within the cradle, inlet and outlet coolant ports to said coolant flow channels, a coolant duct leading from the coolant flow channels to the drive mechanism coolant jacket, means introducing coolant through the inlet, and means for withdrawing coolant through the outlet to achieve a coolant circulation through the cradle and turntable drive mechanism to cool the workpiece holding mechanism.

6. The workpiece holding mechanism of claim 5 wherein the tubular cradle is mounted for rotation in pivot means at each end, wherein one pivot means includes the cradle drive means, and wherein each pivot means is adapted for coolant flow therethrough to or from the cradle cooling passageways.

7. The workpiece holding mechanism of claim 5 wherein a gas sealing means isolate the coolant jacket from the workpiece turntable, the sealing means including a pair of spaced apart O-ring seals forming a sealed off area in the space between the O-ring seals, and means for admitting a gas into that space.

* * * * *